US006729318B2

(12) United States Patent
Torres

(10) Patent No.: US 6,729,318 B2
(45) Date of Patent: May 4, 2004

(54) SYSTEM AND PROCESS FOR CONTROLLING THE STEP RESPONSE OF ELECTRIC COMPONENTS

(75) Inventor: Antonino Torres, Palermo (IT)

(73) Assignee: STMicroelectronics S.r.l., Agrate Brianza (IT)

( * ) Notice: Subject to any disclaimer, the term of this patent is extended or adjusted under 35 U.S.C. 154(b) by 231 days.

(21) Appl. No.: 09/991,554

(22) Filed: Nov. 21, 2001

(65) Prior Publication Data

US 2002/0062825 A1 May 30, 2002

(30) Foreign Application Priority Data

Nov. 24, 2000 (IT) ..... TO2000A1101

(51) Int. Cl.[7] ..... F02P 3/05

(52) U.S. Cl. ..... 123/652; 315/209 R; 327/427; 327/481

(58) Field of Search ..... 123/652; 315/209 R, 315/219, 223, 224, 209 M, 209 T, 651; 327/427, 428, 481, 478

(56) References Cited

U.S. PATENT DOCUMENTS 5,970,964 A * 10/1999 Furuhata et al. ..... 315/209 T
6,495,866 B2 * 12/2002 Kawamoto ..... 257/175

* cited by examiner

*Primary Examiner*—Noah P. Kamen
*Assistant Examiner*—Arnold Castro
(74) *Attorney, Agent, or Firm*—Lisa K. Jorgenson; E. Russell Tarleton; Seed IP Law Group PLLC

(57) ABSTRACT

An electronic component, such as an IGBT, that presents a control terminal for receiving a stepwise control signal and at least one other terminal adapted for reaching a given voltage level by effect of the application of the step signal, with the possibility of overshoot occurring; and a damping resistive element interposed between the control terminal and the at least one other terminal. The damping resistive element shows a current saturated behavior correlated to voltage increase applied at the terminals towards the given voltage level, thus eliminating the risk of occurrence of overshoot in the voltage of the IGBT collector, and preventing the undesired re-ignition of the IGBT when it is in a cut-off condition, by inducing an overvoltage on the collector terminal.

36 Claims, 4 Drawing Sheets

SYSTEM AND PROCESS FOR CONTROLLING THE STEP RESPONSE OF ELECTRIC COMPONENTS

BACKGROUND OF THE INVENTION

1. Field of the Invention

The invention relates to techniques for controlling the step response of electronic components, and with particular reference to electronic ignition systems in motor vehicles, particularly in the car sector.

2. Description of the Related Art

The tendency of using small-sized coils which considerably reduce both the occupied area and the costs of the system, also permitting the implementation of innovative solutions, such as the direct assembly on the engine head, without high-voltage wires, is continuously spreading.

The main disadvantage of using such systems is due to the fact that, since the primary inductance value is generally low driving by means of electronic components capable of switching high currents, e.g., IGBTs (acronym of Insulated Gate Bipolar Transistor), must be resorted to in order to provide sufficient energy during the spark generation phase.

An additional phenomenon found in these systems is the establishment of high parasite capacitance values, which may result in an underdamped step response.

In the described systems, the charging time of the ignition transformer (usually called "coil") is generally determined by a microprocessor which makes the IGBT conduct by means of a trigger pulse.

Working as a closed switch, the IGBT allows the flow of current in the primary winding of the coil. As soon as the current reaches a suitable value, the trigger signal switches to low and cuts off the IGBT, thus causing an overvoltage in the primary winding. The overvoltage, which is limited (typically to a value of approximately 400 V) by a zener diode in the IGBT, is transferred to the secondary winding via the secondary/primary turn ratio of the coil to generate the high voltage needed to produce the spark at the plug.

In practice, the IGBT is energized by a voltage step. In the described conditions (i.e., with an essentially inductive load), an overshoot of the collector voltage is generated when the IGBT exits the saturation region. This phenomenon is unacceptable because, returning to the secondary via the turn ratio, it can originate undesired sparks.

Implementation of the diagram shown in FIG. 1 has previously been proposed to overcome this problem. The diagram is representative per se of both the prior art and of an application according to the invention.

The IGBT is indicated by the corresponding acronym in the diagram in FIG. 1. The diagram also shows the respective collector C, gate G and emitter E terminals.

The collector-emitter line of the IGBT is interposed between the battery voltage B and the ground T in the ignition system connected in series to the primary winding P1 of the ignition transformer (currently called "coil"). Reference P2 indicates the secondary winding of the illustrated transformer, which is structured to power a spark plug SP.

The control action described above is implemented by applying a step control signal generated by a control device such as, for example, a microprocessor MP, to the gate G of the IGBT via a resistor R.

The description above to this point corresponds to principles of operation and implementation criteria which are well known in the art and consequently do not require a detailed description herein.

Equally known is the aforementioned solution consisting in interposing a resistor with a suitable value between the collector C of the IGBT and its control terminal G, which resistor is indicated with numeral 1 in the diagram in FIG. 1.

Particularly, it is possible to see that as the value of the resistor 1 decreases, the detrimental phenomenon of overshoot described above gradually decreases to total disappearance.

This solution however clashes with another difficulty, related to the practical impossibility of operating in fully satisfying ways in solutions which, as in the case of electronic ignition systems, high voltage values, e.g., in the order of 400 V, occur on the primary winding P1 when the IGBT is switched off.

Particularly, in this application, the voltage on the collector C does not reach the desired value because the resistor 1 would cause the IGBT to be switched on again when it should be cut off.

BRIEF SUMMARY OF THE INVENTION

The disclosed embodiments of the invention provide a solution that is capable of overcoming the described shortcomings.

Particularly, the solution according to the invention is based on the use of resistive elements with current saturated behavior correlated to voltage increase.

The phrase "current saturated behavior correlated to voltage increase" herein indicates those resistive elements (usually made of semiconductor structures) susceptible of showing:

- a normal resistive behavior in a first range of voltage values applied to the terminals, i.e., a dependency that is essentially linear of the intensity of the current through the component on the voltage applied across the terminals; and
- a phenomenon of current saturation for which the value of the intensity of the current through the element remains approximately constant (i.e., increases only very slightly, according to a typical asymptotic pattern) with the voltage applied across the terminals of the element as the applied voltage exceeds the first range of values (i.e., exceeds a certain neighbourhood of threshold values).

Resistive elements of this type are known, as documented, for example in European Application EP-A-0 996 158.

An element of this kind is also described in a co-pending U.S. patent application entitled A Structure for a Semiconductor Resistive Element, Particularly for High Voltage Applications and Respective Manufacturing Process filed concurrently herewith in the name of the Applicant.

BRIEF DESCRIPTION OF THE SEVERAL VIEWS OF THE DRAWINGS

Additional characteristics and advantages of the invention will now be described, by way of example only, with reference to the accompanying drawings wherein.

DETAILED DESCRIPTION OF THE INVENTION

Figure 1:
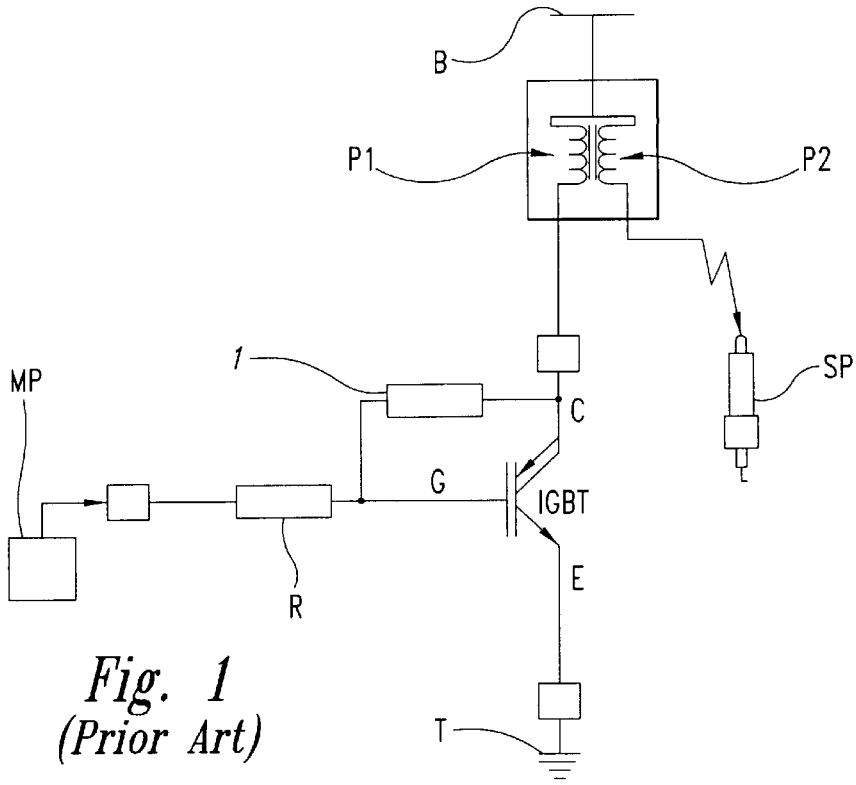
Fig. 1 (Prior Art)
FIG. 1 is per se representative of both the prior art and an application of the solution according to the invention as described above.
Figure 2:
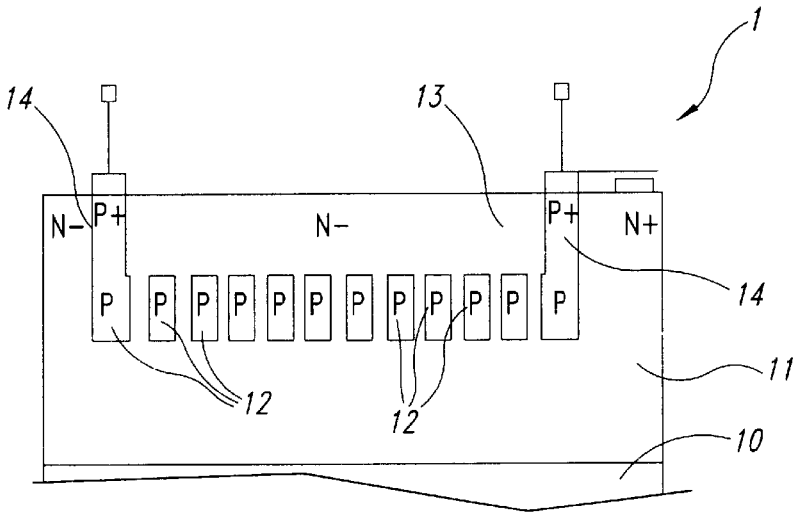
FIG. 2 is a possible embodiment of a resistive element with current saturated behavior correlated to a voltage increase adapted for use in the context of the solution according to the invention.

FIG. 2 schematically illustrates the possibility of making the resistor 1 in the diagram in FIG. 1 in the form of a resistive element presenting a current saturated behavior correlated to voltage increase.

This can be made according to the methods described in greater detail in the patent applications already referred to above.

In essential terms, according to the solution, on a substrate 10 with a first type of conductivity, for example with a high concentration of doping n (substrate n+) an epitaxial layer 11 is grown whose conductivity level is similar that of substrate 10, i.e., of the n type. A region 12 with a second type of conductivity which is opposite to the first type (i.e., in the instant case, with doping p) is formed (typically by photolithography, ion implantation and, preferably, diffusion) and intended to make the body of the resistive element proper.

Preferably, the region 12 is formed by a set of subregions which, upon implantation, are generally reciprocally distinct and made to be at least marginally connected one to the other by diffusion. This particular solution is illustrated in greater detail in the co-pending application filed on even date by the Applicant, to which reference has been made above and which is incorporated by reference herein in its entirety.

An additional layer 13 is grown over the region 12. The layer 13 has again a first type of conductivity, i.e., with doping on type n−, in this case. In such a layer, an additional layer n (not shown) with a higher concentration with respect to the layer 13 can be formed (typically by photolithography, ion implantation and diffusion).

Finally, the structure of the resistive element 1 is completed with the formation of low resistivity end regions p+, indicated by numeral 14, intended to form respective deep contacts with the whole of the regions 12, which are typically configured as buried regions forming the resistive element proper. The structure is completed by the operations currently implemented to make integrated circuits of the type described (formation of a superficial insulating layer of $SiO_2$, formation of contacts and electrodes by metalization, etc.).

It will be appreciated that the aforementioned various types of conductivity (n or p) can be reciprocally reversed, e.g., by making the regions 12 as regions of the n type.

Figure 3:
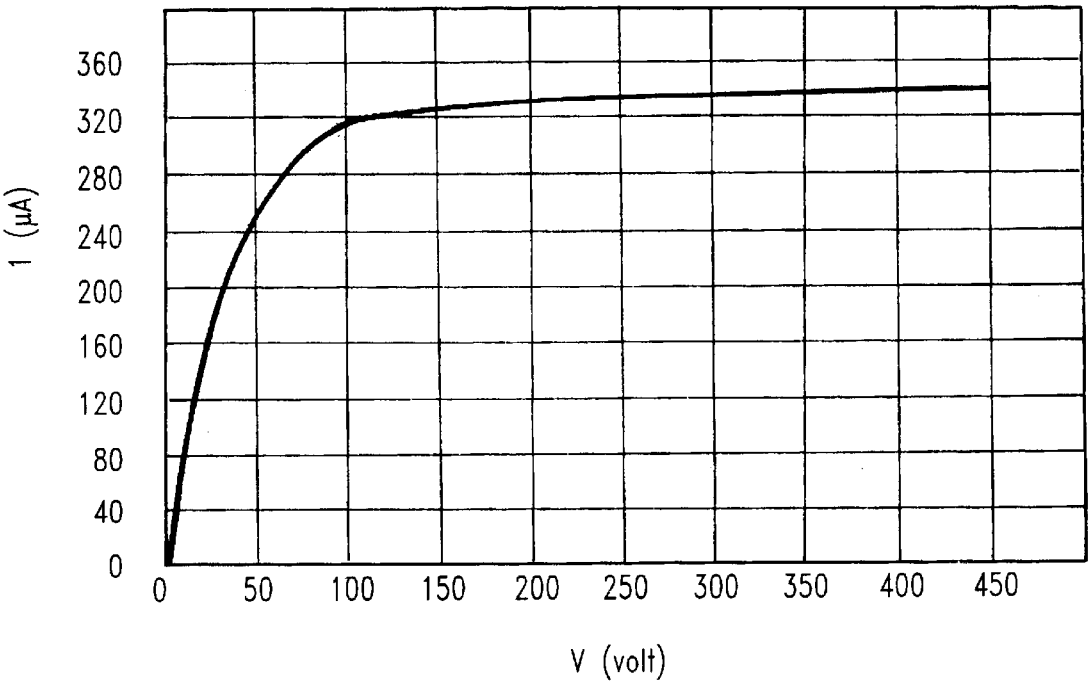
FIG. 3 is a diagram illustrating the typical behavior of current through an element such as that shown in FIG. 2 as the voltage applied to the terminals of the element varies, FIG. 4 comprises three diagrams, indicated with letters a, b, and c, respectively, representing the behavior of some signals found in a system according to the invention.

The overall result which can be obtained is that of creating a "resistive element with current saturated behavior correlated to voltage increase", i.e., an element presenting a current/voltage characteristic of the type shown in FIG. 3.

In this figure, the abscissa shows the value (in volts) of the voltage applied across the terminals of the resistive element and the ordinate shows the corresponding value (in micro ampere) of the current intensity through the element itself.

As can be seen, when the voltage across the terminals of the element is comprised in the range from 0 to approximately 50 V, the element presents an essentially linear current/voltage characteristic (i.e., a resistance value which is nearly constant, e.g., in the order of hundred of KOhms or less).

When the voltage across the terminals of the element increases and exceeds a value equal (in the embodiment shown) to approximately 50 V, said characteristic presenting a typical knee portion corresponding to a gradual, significant increase of the resistance value according to a typical current saturation behavior, until a very high resistivity value (typically in the order of MOhms and over) is reached.

Figure 4:
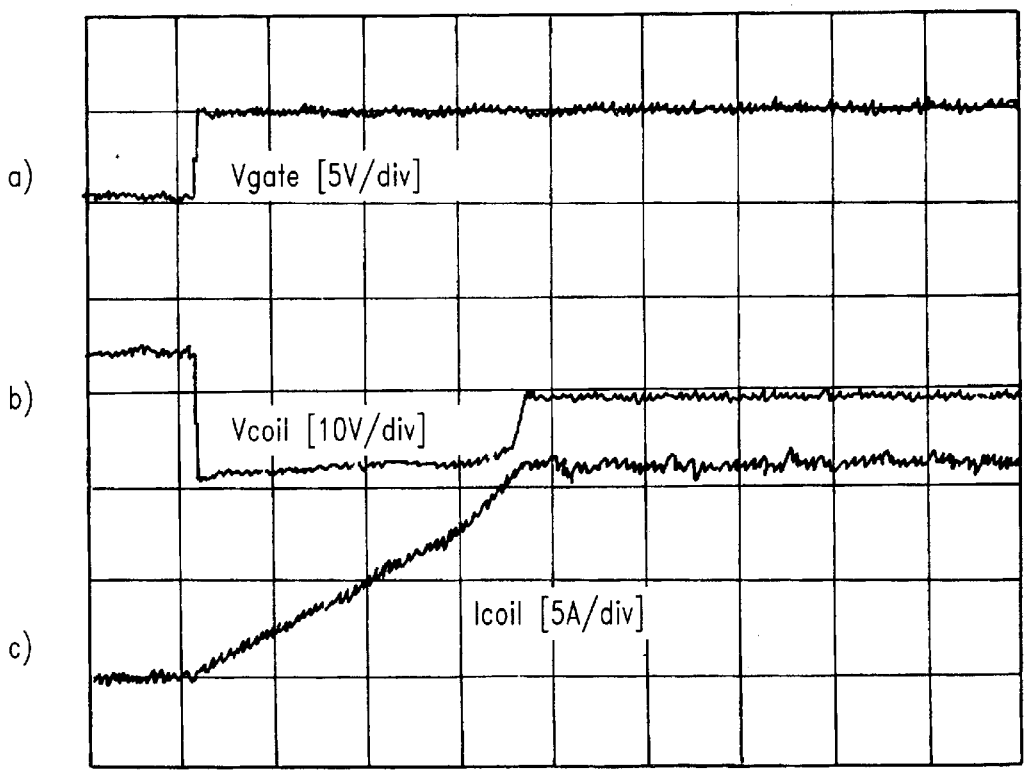

The three superposed diagrams in FIG. 4 respectively show, according to a co-ordinated time scale (shown on the abscissa scale):

- the step signal applied to the gate G of the IGBT (diagram a),
- the corresponding time behavior of voltage on the collector C of the same IGBT (diagram b), and
- the time behavior of the current through the primary winding P1 of the ignition transformer.

It will be easily noted from comparing the diagrams how the IGBT saturates (collector voltage going to a "low" level) with a very clear descent, corresponding to the passage to the "high" value of the voltage on the gate G. In one embodiment, the "high" voltage value being on the order of at least 100 volts.

This determines the gradual increase of current through the primary winding P1 and, when the current reaches a maximum determined value (e.g., 10A), an increase in voltage on the collector C is revealed.

All the behaviors illustrated and described above are manifested, as clearly visible in the diagrams in FIG. 4, in the total absence of overshoot phenomena.

Particularly, the behavior of the system corresponds to a underdamped type response, essentially due to the presence of the resistive element 1, which, being subjected to a "choking" in conditions of high voltage applied across its terminals, i.e., when the power device is switched off, does not prevent the occurrence of overvoltage at the collector, as required by an application such as electronic ignition.

Figure 5:
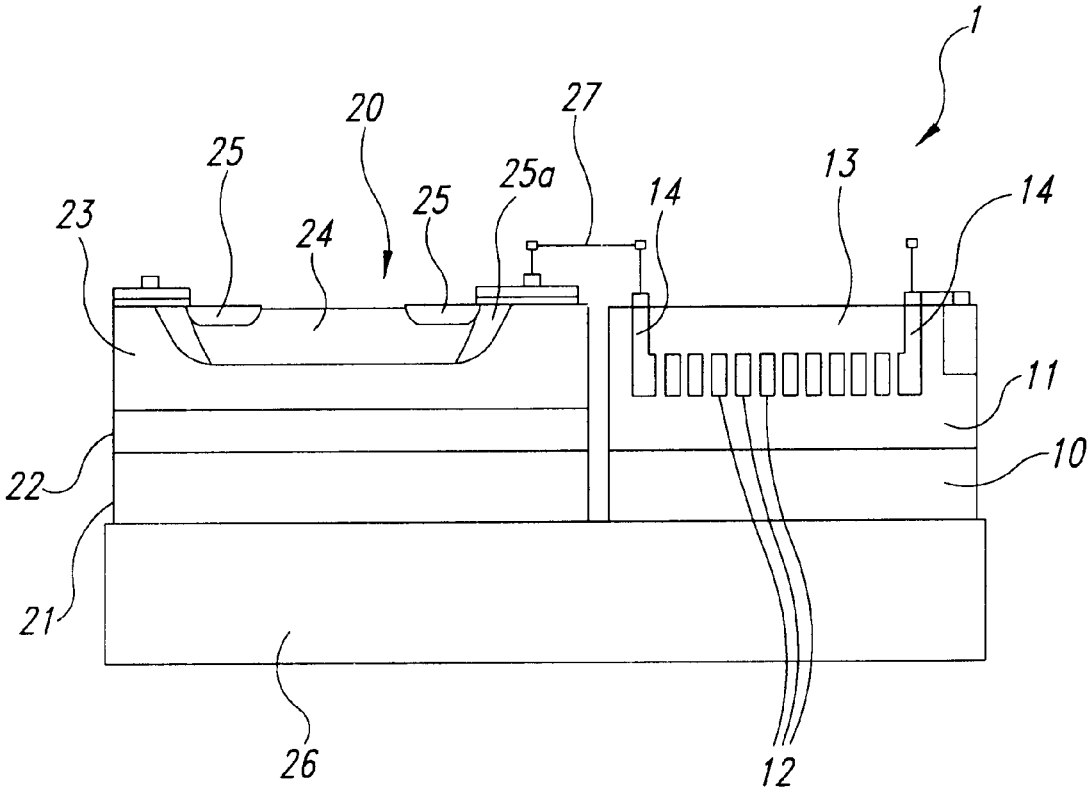
FIGS. 5 and 6 illustrate the possible implementation of the invention in the context of an integrated component.

The diagram in FIG. 5 illustrates the method by which a resistive element of the type illustrated in FIG. 2 can be associated to a power component, such as an IGBT.

With reference to this, the right-hand part of FIG. 5 is very similar to FIG. 2, with the same reference numerals.

The power component (IGBT), generally indicated with numeral 20, corresponds to a structure known per se in the art and comprising the following parts from the bottom upwards:

- a substrate 21 with doping p++,
- a buffer layer 22 with doping n+.
- an epitaxial layer 23 with doping n−,
- a region 24 of type p+, made in the epitaxial layer 23 so as to form the channel or body of the component, and
- two first regions n+, indicated with numeral 25, made in two end portions of the body p+ 24, so to form the emitter region E of the IGBT with associated two outermost additional end regions 25*a*, with doping p−, acting as insulating regions.

The connection of the resistor 1 to the collector C of the IGBT is obtained by arranging the substrates of two dices on a single frame 26 made of electrically conducting material (e.g., a metalized material). Conversely, the connection of the resistor 1 to the gate G of the IGBT is obtained by means of an internal bonding wire, indicated with numeral 27.

Figure 6:
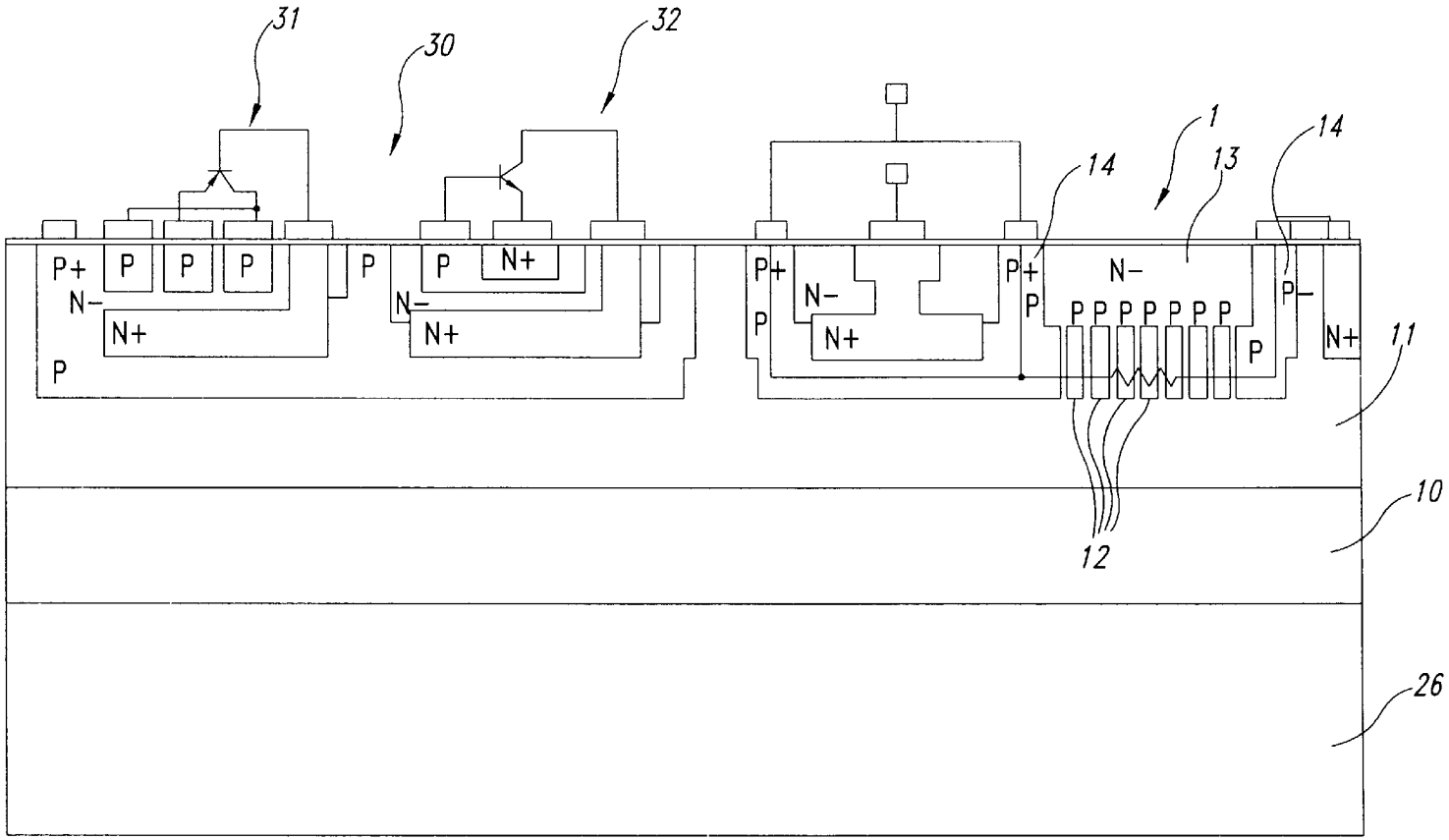

The diagram in FIG. 6 (where the same reference numerals used in FIG. 5 are used to indicate previously described parts and elements) shows the way in which the whole of the elements shown in FIG. 2 (essentially intended to perform a high voltage control function) can be additionally integrated, by extending the frame 26 and the layers 10 and 11, with a low voltage control circuit 30, comprising for example two bipolar transistors 31 and 32 of the pnp and npn type, respectively.

Of course, as mentioned with reference to FIG. 2, the various types of conductivity referred to above can be reciprocally reversed.

It results that the solution according to the invention permits controlling the step response of high voltage devices, adapting it to particular application requirements. Particularly, the exemplary embodiment illustrated herein (which, must be remembered is in fact an example) demonstrates the possibility of controlling an electronic ignition coil eliminating the problem of undesired sparking on the secondary winding at the beginning of the current limitation phase, thereby preventing the occurrence of overshoot phenomena at the IGBT collector.

Naturally, numerous changes can be implemented to the construction and embodiments of the invention herein envisaged without departing from the scope of the present invention, as defined by the following claims.

What is claimed is:

1. A system for controlling an electronic component, having a control terminal for receiving a stepwise control signal and at least one other terminal adapted for reaching a given voltage level by effect of the application of said control signal, said system comprising a damping resistive element interposed between said control terminal and said at least one other terminal, said damping resistive element structured as a resistive element exhibiting a current saturated behavior as the voltage applied across its terminals increases towards said given voltage level, said damping resistive element comprising at least one semiconductor layer with a first type of conductivity, and a buried region with a second type of conductivity, opposite to said first type of conductivity, defining the resistive element proper.

2. The system according to claim 1, wherein said damping resistive element is a resistive element exhibiting a current saturated behavior as the voltage applied across its terminals increases towards said given voltage level in the order on hundreds of Volts.

3. The system of claim 1 wherein said electronic component is an IGBT, for which said control terminal and said at least one other terminal are the gate and the collector of said IGBT, respectively.

4. The system of claim 1, wherein said damping resistive element is an element showing:

a resistive behavior that is essentially linear in a first range of voltage values applied across its terminals, and a phenomenon of current saturation with an increasing resistivity value toward high values when the voltage applied across the terminals of the element increases over said first range of values.

5. The system of claim 4, wherein said range of values extends up to the vicinity of 50 V.

6. The system of claim 1, wherein said buried region is made by implantation and diffusion and preferably comprises a set of subregions which, upon implantation, are reciprocally distinct and made to be at least marginally connected one to the other by diffusion.

7. The system of claim 1, wherein the electronic component and the damping resistive element are mounted on a common conductive substrate; said common conductive substrate comprising a connection between said resistive element and said at least one other terminal of said component.

8. The system of claim 7, comprising a bonding wire that makes the connection between said resistive element and said control terminal of said component.

9. The system of claim 1 wherein the electronic component is associated with an ignition circuit for spark-ignited engines.

10. The system of claim 9, wherein said at least one other terminal of said electronic component is included in a coil current power line in said ignition circuit.

11. The system of claim 10, wherein the electronic component is an IGBT connected with its collector-emitter line in series with the primary winding of said ignition coil.

12. A control system for an electronic component comprising an insulated gate bipolar transistor having a gate terminal for receiving a stepwise control signal, and a collector terminal configured to reach a predetermined voltage level in response to the control signal, the system comprising: a resistive element coupled between the gate terminal and the collector terminal of the insulated gate bipolar transistor, the resistive element formed to have at least one semiconductor layer of a first conductivity type and a buried region of a second conductivity type opposite to the first conductivity type, and including a plurality of implanted subregions separated by and electrically connected by surrounding diffusion, the resistive element structured to reach current saturation at the predetermined voltage level.

13. A system for controlling an electronic component having a control terminal for receiving a stepwise control signal and at least one other terminal adapted for reaching a given voltage level by effect of the application of said control signal, said system comprising a damping resistive element interposed between said control terminal and said at least one other terminal, said damping resistive element structured as a resistive element exhibiting a current saturated behavior as the voltage applied across its terminals increases towards said given voltage level, the electronic component and the damping resistive element are mounted on a common conductive substrate, said common conductive substrate comprising a connection between said resistive element and said at least one other terminal of said component.

14. The system according to claim 13, wherein said damping resistive element is a resistive element exhibiting a current saturated behavior as the voltage applied across its terminals increases towards said given voltage level in the order on hundreds of Volts.

15. The system of claim 13, wherein said electronic component is an IGBT, for which said control terminal and said at least one other terminal are the gate and the collector of said IGBT, respectively.

16. The system of claim 13, wherein said damping resistive element is an element showing:

a resistive behavior that is essentially linear in a first range of voltage values applied across its terminals, and a phenomenon of current saturation with an increasing resistivity value toward high values when the voltage applied across the terminals of the element increases over said first range of values.

17. The system of claim 16, wherein said range of values extends up to the vicinity of 50 V.

18. The system of claim 13, wherein said damping resistive element comprises:

at least one semiconductor layer with a first type of conductivity, and a buried region with a second type of conductivity, opposite to said first type of conductivity, defining the resistive element proper.

19. The system of claim 13, wherein said buried region is made by implantation and diffusion and comprises a set of subregions which, upon implantation, are reciprocally distinct and made to be at least marginally connected one to the other by diffusion.

20. The system of claim 13, comprising a bonding wire that makes the connection between said resistive element and said control terminal of said component.

21. The system of claim 13 wherein the electronic component is associated with an ignition circuit for spark-ignited engines.

22. The system of claim 21, wherein said at least one other terminal of said electronic component is included in a coil current power line in said ignition circuit.

23. The system of claim 22, wherein the electronic component is an IGBT connected with its collector-emitter line in series with the primary winding of said ignition coil.

24. A system for controlling an electronic component, having a control terminal for receiving a stepwise control signal and at least one other terminal adapted for reaching a given voltage level by effect of the application of said control signal, said system comprising a damping resistive element interposed between said control terminal and said at least one other terminal, said damping resistive element structured as a resistive element exhibiting a current saturated behavior as the voltage applied across its terminals increases towards said given voltage level, wherein the electronic component is associated with an ignition circuit for spark-ignited engines.

25. The system according to claim 24, wherein said damping resistive element is a resistive element exhibiting a current saturated behavior as the voltage applied across its terminals increases towards said given voltage level in the order on hundreds of Volts.

26. The system of claim 24 wherein said electronic component is an IGBT, for which said control terminal and said at least one other terminal are the gate and the collector of said IGBT, respectively.

27. The system of claim 24, wherein said damping resistive element is an element showing:

a resistive behavior that is essentially linear in a first range of voltage values applied across its terminals, and a phenomenon of current saturation with an increasing resistivity value toward high values when the voltage applied across the terminals of the element increases over said first range of values.

28. The system of claim 27, wherein said range of values extends up to the vicinity of 50 V.

29. The system of claim 24, wherein said damping resistive element comprises:

at least one semiconductor layer with a first type of conductivity, and a buried region with a second type of conductivity, opposite to said first type of conductivity, defining the resistive element proper.

30. The system of claim 29, wherein said buried region is made by implantation and diffusion and preferably comprises a set of subregions which, upon implantation, are reciprocally distinct and made to be at least marginally connected one to the other by diffusion.

31. The system of claim 24, wherein the electronic component and the damping resistive element are mounted on a common conductive substrate, said common conductive substrate comprising a connection between said resistive element and said at least one other terminal of said component.

32. The system of claim 31, comprising a bonding wire that makes the connection between said resistive element and said control terminal of said component.

33. The system of claim 32, wherein said at least one other terminal of said electronic component is included in a coil current power line in said ignition circuit.

34. The system of claim 33, wherein the electronic component is an IGBT connected with its collector-emitter line in series with the primary winding of said ignition coil.

35. An electronic ignition system, comprising:

an insulated gate bipolar transistor having a gate terminal configured to receive a stepwise control signal, a collector terminal configured to reach a predetermined voltage level in response to the control signal, and an emitter terminal coupled to an ignition coil, with the collector and emitter terminals connected in series with a primary winding in the ignition coil; and a resistive element coupled between the gate and collector terminals of the insulated gate bipolar transistor, the resistive element formed to have at least one semiconductor layer of a first conductivity type and a buried region of a second conductivity type opposite to the first conductivity type, and including a plurality of implanted subregions formed in the buried regions and separated by and electrically connected by surrounding diffusion, the resistive element structured to reach current saturation at the predetermined voltage level.

36. The system of claim 35, wherein the predetermined voltage level is at least 100 volts.

* * * * *

UNITED STATES PATENT AND TRADEMARK OFFICE

CERTIFICATE OF CORRECTION

PATENT NO. : 6,729,318 B2
DATED : May 4, 2004
INVENTOR(S) : Antonio Torres

It is certified that error appears in the above-identified patent and that said Letters Patent is hereby corrected as shown below:

Title page,
Item [54], "SYSTEM AND PROCESS FOR CONTROLLING THE STEP RESPONSE OF ELECTRIC COMPONENTS" should read -- SYSTEM AND PROCESS FOR CONTROLLING THE STEP RESPONSE OF ELECTRONIC COMPONENTS --.

Signed and Sealed this

Seventeenth Day of August, 2004

JON W. DUDAS
*Acting Director of the United States Patent and Trademark Office*